US006706669B2

(12) United States Patent
Sartori et al.

(10) Patent No.: US 6,706,669 B2
(45) Date of Patent: Mar. 16, 2004

(54) METHOD FOR INHIBITING CORROSION USING PHOSPHOROUS ACID

(75) Inventors: Guido Sartori, Milan (IT); David Craig Dalrymple, Bloomsbury, NJ (US); Saul Charles Blum, Edison, NJ (US); Liza Marie Monette, Whitehouse, NJ (US); Mohsen S. Yeganeh, Piscataway, NJ (US); Andreas Vogel, Steinfeld (DE)

(73) Assignee: ExxonMobil Research and Engineering Company, Annandale, NJ (US)

( * ) Notice: Subject to any disclaimer, the term of this patent is extended or adjusted under 35 U.S.C. 154(b) by 9 days.

(21) Appl. No.: 09/905,229

(22) Filed: Jul. 13, 2001

(65) Prior Publication Data

US 2003/0012683 A1 Jan. 16, 2003

(51) Int. Cl.[7] ..... C23F 11/167; C09K 15/02

(52) U.S. Cl. ..... 507/274; 507/934; 507/939; 252/389.24; 252/400.24; 106/14.12; 106/14.05; 166/902

(58) Field of Search ..... 252/389.24, 400.24; 507/269, 274, 934, 939; 106/14.12, 14.26, 14.05; 166/902; 427/435; 422/7, 12, 17; 148/320

(56) References Cited

U.S. PATENT DOCUMENTS

| | | | | |
|---|---|---|---|---|
| 1,872,091 A | | 8/1932 | Mougey | 148/253 |
| 2,326,837 A | | 8/1943 | Coleman | 134/27 |
| 2,901,424 A | | 8/1959 | Burke | 208/348 |
| 3,132,975 A | | 5/1964 | Freud | 148/243 |
| 3,261,774 A | | 7/1966 | Newkirk et al. | 208/48 |
| 3,460,989 A | | 8/1969 | Rusch | 134/3 |
| 3,522,093 A | | 7/1970 | Woolman | 134/22 |
| 3,531,394 A | | 9/1970 | Koszman | 208/48 |
| 3,558,470 A | | 1/1971 | Gillespie et al. | 208/48 |
| 3,578,731 A | | 5/1971 | Mange et al. | 260/929 |
| 3,645,886 A | | 2/1972 | Gillespie et al. | 208/48 |
| 3,647,677 A | | 3/1972 | Wolff et al. | 208/48 |
| 4,024,051 A | | 5/1977 | Shell et al. | 208/348 |
| 4,105,540 A | | 8/1978 | Weinland | 208/48 |
| 4,110,127 A | | 8/1978 | Longuepee et al. | 148/6.15 |
| 4,358,389 A | * | 11/1982 | Konig-Lumer et al. | 252/70 |
| 4,389,371 A | * | 6/1983 | Wilson et al. | 422/15 |
| 4,425,223 A | | 1/1984 | Miller | 208/48 |
| 4,752,374 A | | 6/1988 | Reid | 208/48 |
| 4,842,716 A | | 6/1989 | Kaplan et al. | 208/48 |
| 4,941,994 A | | 7/1990 | Zetlmeisl et al. | 252/389.23 |
| 5,314,643 A | | 5/1994 | Edmondson et al. | 252/389.23 |
| 5,360,531 A | | 11/1994 | Tong et al. | 208/48 |
| 5,425,267 A | | 6/1995 | Herrmann et al. | 73/86 |
| 5,498,813 A | | 3/1996 | Arnst | 585/466 |
| 5,500,107 A | | 3/1996 | Edmondson | 208/47 |
| 5,503,006 A | | 4/1996 | Babaian-Kibala et al. | 73/86 |
| 5,552,085 A | | 9/1996 | Babaian-Kibala | 252/389.23 |
| 5,611,991 A | | 3/1997 | Naraghi | 422/15 |
| 5,630,964 A | | 5/1997 | Babaian-Kibala et al. | 252/369.23 |
| 5,863,415 A | | 1/1999 | Zetlmeisl | 208/47 |

OTHER PUBLICATIONS

An 1996: 692850 Caplus, "*Effect of phosphonate inhibitors on calcite nucleation kinetics as a function of temperature using light scattering in an autoclave*", Jonasson, R. G., et al.—Chem. Geol. (1996), 132(1–4), 215–225.

An 1992: 615939 Caplus.

Vaish, et al., Ind. Eng. Chem. Res. 1989 28, 1293–1299 "*Triphenyl Phosphite as a Coke Inhibitor during Naphtha Pyrolysis*".

Abstract of Belg. 613, 686 Aug. 8, 1962, "*Improving the Corrosion Resistance of Metal Surfaces*".

Gunasekaran, et al., "*Inhibition by phosphonic acids—an overview*", Anti–Corrosion Methods and Materials, vol. 44–No. 4, pp. 248–259.

* cited by examiner

*Primary Examiner*—Joseph D. Anthony
(74) *Attorney, Agent, or Firm*—Linda M. Scuorzo

(57) ABSTRACT

The present invention relates to a method for inhibiting high temperature of corrosion-prone metal surfaces by organic acid-containing petroleum streams by providing an effective corrosion-inhibiting amount of phosphorous acid, typically up to 1000 wppm, to the metal surface.

4 Claims, No Drawings

METHOD FOR INHIBITING CORROSION USING PHOSPHOROUS ACID

FIELD OF THE INVENTION

The present invention relates to a process for inhibiting the high temperature corrosivity of petroleum oils.

BACKGROUND OF THE INVENTION

Whole crudes and crude fractions with acid, including high organic acid content such as those containing carboxylic acids, (e.g., naphthenic acids), are corrosive to the equipment used to distill, extract, transport and process the crudes. Solutions to this problem have included use of corrosion-resistant alloys for equipment, addition of corrosion inhibitors, or neutralization of the organic acids with various bases.

The installation of corrosion-resistant alloys is capital intensive, as alloys such as 304 and 316 stainless steels are several times the cost of carbon steel. The corrosion inhibitors solution is less capital intensive, however costs can become an issue.

Organic polysulfides (Babaian-Kibala, U.S. Pat. No. 5,552,085), organic phosphites (Zetlmeisl, U.S. Pat. No. 4,941,994), and phosphate/phosphite esters (Babaian-Kibala, U.S. Pat. No. 5,630,964), have been claimed to be effective in hydrocarbon-rich phase against naphthenic acid corrosion. However, their high oil solubility incurs the risk of distillate sidestream contamination by phosphorus.

Phosphoric acid has been used primarily in aqueous phase for the formation of a phosphate/iron complex film on steel surfaces for corrosion inhibition or other applications (Coslett, British patent 8,667, U.S. Pat. Nos. 3,132,975, 3,460,989 and 1,872,091). Phosphoric acid use in high temperature non-aqueous environments (petroleum) has also been reported for purposes of fouling mitigation (U.S. Pat. No. 3,145,886).

There remains a continuing need to develop additional options for mitigating the corrosivity of acidic crudes at lower cost. This is especially true at times of low refining margins and a high availability of corrosive crudes from sources such as Europe, China or Africa. Applicants' invention addresses this need.

SUMMARY OF THE INVENTION

An embodiment of the present invention is a method for inhibiting high temperature corrosion of corrosion prone metal surfaces caused by organic, typically, naphthenic acids in petroleum streams by providing the metal surface with an effective, corrosion-inhibiting amount of phosphorous acid.

Another embodiment of the invention is a method to inhibit the high temperature corrosivity of an organic acid-containing petroleum stream or oil by providing a corrosion prone metal-containing surface to be exposed to the acid-containing petroleum stream or oil with an effective, corrosion-inhibiting amount of phosphorous acid at a temperature and under conditions sufficient to inhibit corrosion of the metal surface. The providing of the phosphorous acid may be carried out in the presence of the organic acid-containing petroleum stream and/or as a pretreatment of the corrosion prone metal surface before exposure to the organic acid-containing petroleum stream. Corrosion prone metal surfaces include iron and iron-containing metals such as alloys.

Another embodiment includes the products produced by the processes herein.

The present invention may suitably comprise, consist, or consist essentially of the elements or steps disclosed and may be practiced in the absence of an element or step not disclosed.

DETAILED DESCRIPTION OF THE PREFERRED EMBODIMENTS

Some petroleum streams, including petroleum oils, contain acids, including organic acids such as naphthenic acids, that contribute to high temperature corrosion of internal surfaces of refinery equipment. Organic acids generally fall within the category of naphthenic and other organic acids. Naphthenic acid is a generic term used to identify a mixture of organic carboxylic acids present in petroleum stocks. Naphthenic acids may be present either alone or in combination with other organic acids, such as phenols. Naphthenic acids alone or in combination with other organic acids can cause corrosion at high temperatures, in non-aqueous or essentially non-aqueous (hydrocarbon) environments i.e. at temperatures ranging from about 200° C. (392° F.) to 420° C. (790° F.). Inorganic acids also may be present. Inhibition of corrosion due to the organic acid content of such petroleum streams, is desirable in order to increase the corrosion resistance, and thus useful life of internal (i.e., tube-side surfaces of reactors and other equipment having an external and shell-side and an internal or tube-side) metal surfaces of refinery equipment that are high temperature corrosion prone and are to be exposed to organic acid-containing petroleum streams at process conditions that result in high temperature corrosion of such internal surfaces. Examples of such equipment include heat exchanger surfaces, pipestill vessels, transfer lines and piping, and pumps. Examples of metal surfaces that may benefit from treatment are ferrous metals such as carbon steel and iron alloys.

The petroleum streams that can be treated herein, including whole crudes and crude oil fractions. As used herein, the term whole crudes means unrefined, non-distilled crudes.

Phosphorous acid may be added at any temperature, ambient to the temperature range in which corrosion occurs, depending on when it is desired to initiate treatment.

The phosphorous acid is introduced in either a batch or continuous process to untreated (unadditized) petroleum oil. Additionally or separately, the metal surface may also be preconditioned by adding to a low acidity petroleum feed an amount of phosphorous acid effective to inhibit corrosion in the organic acid-containing petroleum oil to be treated before combination with the petroleum stream containing organic acids by techniques known in the industry. Additional effective amounts may be introduced into the organic acid-containing petroleum stream itself as needed to maintain corrosion inhibition. Desirably, a continuous dosing of phosphorous acid to achieve and maintain the recommended level of corrosion inhibition is delivered. Typically, a reduction corresponding to at least a fifty (50) percent corrosion rate reduction can be achieved. Thus, the phosphorous acid may be introduced to the hydrocarbon-side phase or to the metal surface itself.

The phosphorous acid is added in effective amounts, typically up to a total of 1000 wppm, more typically, an effective amount of from about 10–2000 wppm, most preferably 50–150 wppm.

The effectiveness of corrosion inhibition is typically estimated in the laboratory by weight loss of metal coupons exposed to organic acids with and without the phosphorous acid present. The relative decrease in metal weight loss due to the presence of corrosion inhibitor is a measure of the effectiveness of corrosion inhibition.

Naphthenic acid concentration in crude oil is determined by titration of the oil with KOH, until all acids have been neutralized. The concentration is reported in Total Acid Number (TAN) unit, i.e., mg of KOH needed to neutralize 1 gram of oil. It may be determined by titration according to ASTM D-664. Any acidic petroleum oil may be treated according to the present invention, for example, oils having an acid neutralization of about 0.5 mg KOH/g or greater.

The following examples illustrate the invention.

EXAMPLE 1

The reaction apparatus consisted of a 500 ml round bottom flask under nitrogen atmosphere. 288.9 grams of Tufflo oil was put in the flask, then 12 mg of phosphorous acid were added. The flask contents were brought to 300° C. and a carbon steel coupon with dimensions 7/16 in.×11/16 in.×1/8 in. was immersed. Initial coupon weight was determined to be 4.7614 g. After an hour, 11.1 grams of naphthenic acids were added, giving a total acid number of 8 mg KOH/g. The oil was kept at 300° C. for an additional 4 hours. The coupon weighed 4.7408 g after this procedure, corresponding to a corrosion rate of 377 mils per year.

EXAMPLE 2

Comparative

The procedure was the same as in example 1, but without phosphorous acid. The coupon was kept in oil at 300° C. for four hours. The weight loss corresponded to a corrosion rate of 480 mils per year. Thus, in Example 1, a 21% corrosion rate reduction was measured when phosphorous acid was present versus Example 2 when this compound was absent.

EXAMPLE 3

The procedure was the same as in example 1, but the amount of phosphorous acid added was 21 mg. The weight loss corresponded to a corrosion rate of 183 mils per year. Thus, in example 3, a 62% corrosion rate reduction was measured when phosphorous acid was present versus Example 2 when this compound was absent.

EXAMPLE 4

The procedure was the same as in example 1, but the amount of phosphorous acid added was 30 mg. The weight loss corresponded to a corrosion rate of 38 mils per year. Thus, in example 4, a 92% corrosion rate reduction was measured when phosphorous acid was present versus Example 2 when this compound was absent.

EXAMPLE 5

Comparative

The procedure was the same as in example 1, but a 30 mg amount of phosphoric acid was added instead. The weight loss corresponded to a corrosion rate of 294 mils per year. Thus, in example 5, only a 39% corrosion rate reduction was measured when 100 ppm of phosphoric acid was present versus Example 4, where a 92% corrosion rate reduction was measured when 100 ppm of phosphorous acid was present.

What is claimed is:

1. A process for inhibiting the high temperature corrosivity at temperatures of from 200° C. to 420° C. of an organic acid-containing petroleum stream, by providing a corrosion prone internal metal equipment surface to be exposed to such organic acid-containing stream with an effective, corrosion-inhibiting amount of phosphorus acid contained within said petroleum stream.

2. The process of claim 1, wherein the amount of phosphorous is an effective amount of up to 1000 wppm.

3. The process of claim 1 wherein the process is carried out at a temperature ranging from about ambient to below the cracking.

4. The process of claim 1 wherein the metal is an iron-containing metal.

* * * * *